United States Patent [19]

Wieland et al.

[11] Patent Number: 4,964,521

[45] Date of Patent: Oct. 23, 1990

[54] AMPULS AND APPARATUS THEREON FOR OPENING SAME

[75] Inventors: Gerhard Wieland, Bensheim; Klaus Steckenreuter; Wolfgang Gernand, both of Darmstadt; Helmut Simgen, Mehlingen, all of Fed. Rep. of Germany

[73] Assignee: Merck Patent Gesellschaft Mit Beschränkter Haftung, Darmstadt, Fed. Rep. of Germany

[21] Appl. No.: 322,385

[22] Filed: Mar. 13, 1989

[30] Foreign Application Priority Data

Mar. 12, 1988 [DE] Fed. Rep. of Germany ..... 3808308

[51] Int. Cl.[5] ..... B65D 51/22

[52] U.S. Cl. ..... 215/32; 215/2

[58] Field of Search ..... 215/31–35.2; 206/531, 532

[56] References Cited

U.S. PATENT DOCUMENTS

| | | | |
|---|---|---|---|
| 3,784,045 | 1/1974 | Komendowski | 215/32 X |
| 3,858,739 | 1/1975 | Turner et al. | 215/32 |
| 4,747,501 | 5/1988 | Greaves | 215/32 X |

FOREIGN PATENT DOCUMENTS

| | | | |
|---|---|---|---|
| 73644 | 9/1960 | France | 215/32 |
| 2209292 | 6/1974 | France | 215/32 |
| 601606 | 5/1948 | United Kingdom | 215/32 |
| 2039267 | 8/1980 | United Kingdom | 215/32 |

*Primary Examiner*—William Price

*Attorney, Agent, or Firm*—Millen, White & Zelano

[57] ABSTRACT

The invention relates to opening aids for an ampul which is closed by upper and lower plastic membranes. The opening aids are funnel-shaped sleeves, one of which contains a membrane welded to one of the plastic membranes closing the ampul, and the other of which includes a plastic punch for rupturing the upper membrane.

11 Claims, 1 Drawing Sheet

AMPULS AND APPARATUS THEREON FOR OPENING SAME

BACKGROUND OF THE INVENTION

The invention relates to opening aids for ampuls, which ensure a reliable and safe opening of ampuls and at the same time facilitate quick transfer of ampul content, without loss, into a vessel, which may be, for example, a volumetric flask or a beaker.

The ampuls under consideration are in particular plastic ampuls containing concentrated solutions for the preparation of volumetric, standard and buffer solutions. Probably the best known opening aids for these ampuls are glass rods. With respect to equipment safety laws, glass rods are implements which entail considerable risk of injury. When using the typical glass rod of up to 30 cm long, the rod may break impaling the hand holding the rod on the resulting splintered glass stub.

A further development is the plastic-sheathed glass rod; however, these rods have a number of disadvantages, i.e., the behavior of water and aqueous solutions as they drain off these rods is unfavorable; the sheathing may become detached at the glass/plastic interface, and plastic sheathed glass rods are disproportionately expensive.

Plastic and metal rods cannot be used repeatedly due to their resistance to cleaning agents used in volumetric analysis (ethanolic potassium hydroxide solution or chromic-sulfuric acid). Moreover, a metal rod must also not be used in the field of trace analysis of metals, in that the metal will contaminate standard solutions.

Another opening aid for ampuls currently on the market is a special plastic knife: however, this aid has the following disadvantages: loss of the ampul content because the knife cannot be rinsed; loss of the ampul content when turning around an ampul opened on one side; and if the volumetric flask is fitted onto the ampul before turning it around and both are turned around together, the volumetric flask may break. In addition, if the opening on the end of the ampul is too small, the content runs out very slowly and rinsing out the ampul is difficult.

Although an opening aid for ampuls closed by plastic membranes is described in German Offenlegungsschrift No. 3,531,071, the embodiment still has a number of disadvantages in that, to open the ampul, the membrane has to be pressed in from outside. As the membrane cannot be removed completely in this way, a dead volume occurs behind the pressed-in membrane, in which liquid collects that cannot be rinsed out completely. A quantitative rinsing out is therefore not ensured. The liquid also has to flow out via an inner tube, the diameter of which must, of course, be smaller than the ampul neck itself. Between the two tubes there is a dead volume, which makes a quantitative rinsing out impossible. Welding of the cutting edge to the membrane, as proposed in German Offenlegungsschrift No. 3,531,071 is likewise not a satisfactory solution to the problem in that welding causes holes to occur in the membranes in a high proportion of the ampuls. Moreover, the opening which can be achieved by spot-welding of the cutting edge is very small, so that a quick flow of the content out of the ampul is impossible.

SUMMARY OF THE INVENTION

The invention has as an object providing opening aids which allow quick and quantitative emptying of the ampul content with little subsequent rinsing out and with which the disadvantages described above do not occur.

Surprisingly, it has been found that two planar membranes can be welded in a sealed manner over a sizable area and that only low torsional and axially directed forces, such as occur during the screwing on of the opening aid, are needed to tear the welded membranes. As a result, an opening of the ampul over the entire welded surface can be achieved. No dead volumes occur in the ampul and the ampul content flows out quickly.

BRIEF DESCRIPTION OF THE DRAWINGS

Various other objects, features and attendant advantages of the present invention will be more fully appreciated as the same becomes better understood when considered in conjunction with the accompanying drawings in which like reference characters designate the same or similar parts throughout the several views, and wherein.

Figure 1:
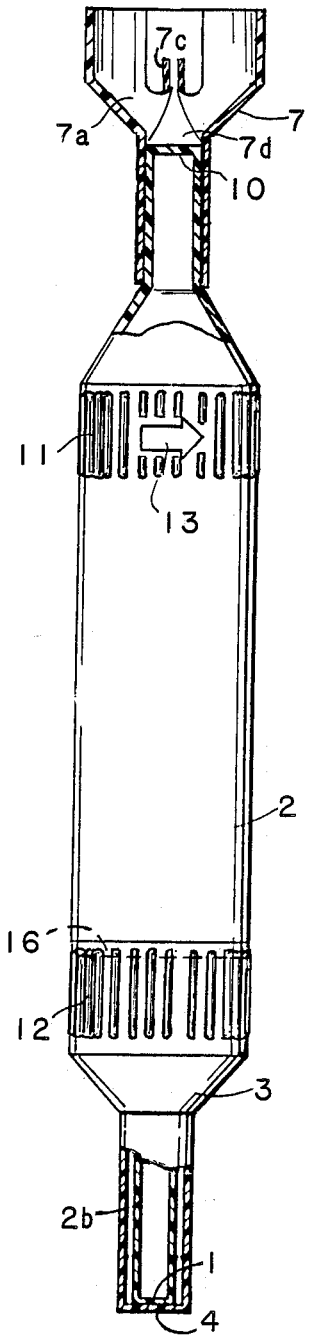
FIG. 1 is a side view, partially in section, of an ampul in combination with ampul opening apparatus in accordance with the instant invention.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire texts of all applications, patents and publications, cited above and below, and of corresponding German application P 38 08 308, are hereby incorporated by reference.

DESCRIPTION OF THE PREFERRED EMBODIMENT

The invention relates to opening aids for ampuls 2, in the form of a sleeve 3 configured as a funnel, which ampuls are closed by plastic membranes and are characterized in that the sleeve contains a membrane 4 welded to a plastic membrane 1. The membrane 1 is attached to the lower end of the sleeve 3 and is connected to the sleeve 3 by at least two webs 5. Opening aid 3 and ampul 2 are designed such that a screwing movement via a thread 6 is converted into axial movement of the opening aid sleeve 3.

Figure 3:
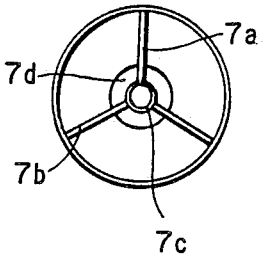
FIG. 3 is a top end view of the ampul of Figure 1.
Figure 2:
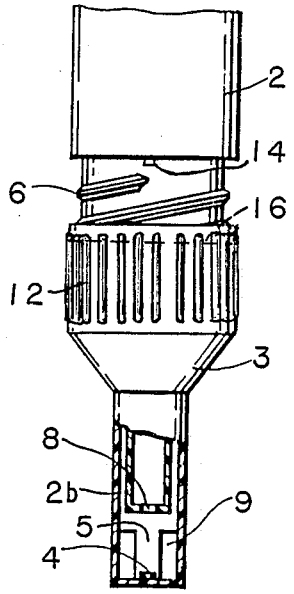
FIG. 2 is a side view, similar to FIG. 1, showing a lower end cap comprised of a sleeve which is unscrewed to open one end of the ampul.

A preferred embodiment of the ampul with the opening aid according to the invention is shown in FIG. 1, wherein: 1 denotes the plastic membrane, 2 denotes the ampul, 3 denotes the sleeve or lower end cap and 4 denotes the membrane welded to the plastic membrane 1. FIG. 2 shows the lower part of the ampul in opened condition, the webs 5 and the thread 6 being exposed. FIG. 3 shows a top view of an upper funnel-shaped sleeve 7, which has therein an upwardly directed stem 7c, which is held via at least two webs 7a and 7b such that a liquid flow via the interstices 7d is possible.

The actual ampul-like liquid container 2 is preferably of cylindrical design. At the lower end it includes means for guiding the end cap or lower sleeve 3, preferably in the form of a thread. The ampul 2 has at the upper end and lower end ampul necks, 2a and 2b, respectively, the diameter of which is smaller than that of the ampul body itself. In particular, the neck at the discharge point of the ampul has a diameter such that the ampul content can also be emptied into a volumetric flask with standard ground joint NS 14/23. The ampul necks 2a and 2b are closed by plastic membranes 1 and 10, respectively, which are ruptured to empty the ampul.

The funnel-shaped sleeve or end cap 3 has a means adapted to the guide element on the ampul, for example, a counterthread or a guide groove, and bears on the lower funnel neck a membrane 4 held by at least two, preferably three, webs. The sleeve 3 is welded to membrane 1 via the surface 4, preferably with formation of an annular predetermined breaking point.

All parts of the ampul and of the opening aids according to the invention consist of plastics such as polyethylene, polypropylene, polyvinylidene difluoride or methylpentene polymers. The dimensions may be chosen according to the required liquid quantities. For example, an ampul having a capacity of 100 $cm^3$ is, including the tubular extensions, approximately 160–200 mm long and has a diameter of approximately 25–35 mm.

The ampul body 2 and the lower sleeve 3 designed in the form of a funnel are coupled via the thread 6. Turning the ampul body 2 counterclockwise while at the same time holding the sleeve 3 in place causes an axially directed force to act on the weld, which force tears the membrane 1. In the case of the preferred embodiment, this produces a circular hole 8, the diameter of which corresponds virtually to the inner diameter of the ampul neck. The upward movement of the ampul during turning of the ampul body 2 causes the membrane material which, in closed condition, connects ampul body 2 and sleeve 3 to be moved away such that the free flow of the liquid contained in the ampul is not obstructed.

The ampul content can be emptied via lateral openings 9 in the sleeve 3 into a container such as a volumetric flask.

Figure 4:
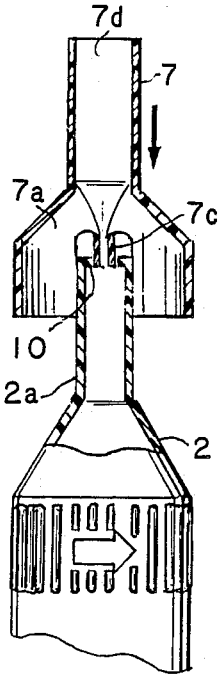
FIG. 4 is a side view, mostly in section, showing operation of an upper end funnel which has an edge thereon used to rupture a membrane covering the upper end of the ampul.

In the preferred embodiment, opening of the upper membrane 10 takes place by pressing the punch or stem 7c in the sleeve 7 through membrane 10. As seen in FIG. 4, the funnel 7 is removed and inverted for this purpose. After rupturing the membrane 10, the funnel is replaced to the FIG. 1 position. A rinsing through or rerinsing of the ampul is facilitated by passing the rinsing liquid through the openings 7d of the funnel.

Ease in opening the ampul is enhanced by ribs 11 and 12 on the ampul body 2 and lowr sleeve 3, respectively, which ribs are gripped for opening. An arrow 13 on the ampul body 2 informs one as to the direction one must rotate the ampul body to break the seal 4. The small rib 14 projecting from the ampul body 2 cooperates with internal ribs 16 on the lower sleeve 3 to ratchet as the lower sleeve rotates with respect to the ampul body so as to let one know that the sleeve is turning with respect to the body rather than just twisting. Ribs 7a and 7b stiffen the funnel 7 while helping to align the punch 7c with the membrane 10 in the top neck 2a.

The pening according to the invention ensures safe opening of the ampuls and a quick, complete transfer, without any loss, of the ampul content into a volumetric flask or beaker. no other aids, which may be hazardous or adversely affect the ampul content, are necessary for opening of the ampul.

From the foregoing description, one skilled in the art cna easily ascertain the essential characteristics of this invention, and without departing from the spirit and scope thereof, can make various changes and modifications of the invention to adapt it to various usages and conditions.

What is claimed is:

1. An opening aid for ampuls (2) which are closed by plastic membranes (1), the opening aid being in the form of a sleeve (3) configured as a funnel, wherein the sleeve contains a membrane (4) welded to the plastic membrane (1).

2. The opening aid according to claim 1, wherein the membrane (4) is positioned at the lower end of the sleeve (3).

3. The opening aid according to claim 1, wherein the membrane (4) is connected to the sleeve (3) via at least two webs (5).

4. The opening aid according to claim 1, characterized in that the opening aid and ampul (2) are configured such that a rotary movement via a thread (6) is converted into an axial movement of the sleeve to rupture the membrane.

5. An ampul including apparatus associated therewith to facilitate opening, emptying and rinsing the ampul, the ampul and apparatus comprising:

an ampul body of a first diameter, said ampul body having upper and lower end portions having upper and lower end openings therethrough;

first and second membranes covering said upper and lower end openings, respectively;

helical thread means on the ampul body adjacent the lower end portion;

a lower end cap having helical means cooperating with the helical thread means on the lower end portion when the lower end cap is in the closed position, the lower end cap having a portion thereon welded to the first membrane wherein when the lower end cap is rotated with respect to the ampul body, the lower end cap moves axially with respect to the ampul body and ruptures the first membrane to allow liquid in the first membrane to flow out through the lower end portion of the ampul; and means for rupturing the second membrane closing the upper end opening of the ampul.

6. The ampul and apparatus of claim 5, wherein the means for rupturing the upper membrane comprises a funnel-shaped cap having a sleeve portion which fits over the upper end portion of the ampul and an enlarged portion, the enlarged end portion contains a seal rupturing device supported therein, and provides a funnel opening for rinsing the ampul of residual contents after the membrane at the lower end thereof has been ruptured.

7. The ampul and apparatus of claim 6, wherein the bottom cap includes a lower end having lateral openings adjacent thereto through which openings liquid flows from the ampul as the ampul is emptied after the lower end cap has been axially advanced to rupture the lower membrane.

8. The ampul and apparatus of claim 5, wherein the bottom cap includes a lower end having lateral openings adjacent thereto through which openings liquid flows from the ampul as the ampul is emptied after the lower end cap has been axially advanced to rupture the lower membrane.

9. The ampul and apparatus of claim 6, wherein the upper and lower end portions have diameters less than the diameter of the ampul body and wherein the upper and lower end caps have neck portions of reduced diameter.

10. The ampul and apparatus of claim 9, wherein the lower end cap has an internal diameter slightly greater than the external diameter of the lower end portion and the upper end cap has an internal diameter approximating that of the external diameter of the upper end portion so as to have a friction fit therewith.

11. The ampul and apparatus of claim 10, wherein the device for rupturing the upper seal comprises a circular, hollow punch supported by flanges within the funnel portion of the upper cap.

* * * * *